US006887363B2

(12) United States Patent
Andreae et al.

(10) Patent No.: US 6,887,363 B2
(45) Date of Patent: May 3, 2005

(54) GROUNDING SYSTEM FOR ROTATING FIXTURES IN ELECTRICALLY CONDUCTIVE MEDIUMS

(75) Inventors: Bradley M. Andreae, Sturgeon Bay, WI (US); Bradley S. Andreae, Sturgeon Bay, WI (US)

(73) Assignee: SST Corporation, Sturgeon Bay, WI (US)

( * ) Notice: Subject to any disclaimer, the term of this patent is extended or adjusted under 35 U.S.C. 154(b) by 696 days.

(21) Appl. No.: 09/997,486

(22) Filed: Nov. 20, 2001

(65) Prior Publication Data

US 2003/0094363 A1 May 22, 2003

(51) Int. Cl.[7] ..... C25D 17/00
(52) U.S. Cl. ..... 204/623; 204/213; 204/214
(58) Field of Search ..... 204/213, 214, 204/623

(56) References Cited

U.S. PATENT DOCUMENTS

| | | | |
|---|---|---|---|
| 4,165,242 | A | 8/1979 | Kelly et al. |
| 4,422,774 | A | 12/1983 | Little |
| 4,537,669 | A | 8/1985 | McInnes |
| 4,544,475 | A | 10/1985 | Heffner et al. |
| 4,942,956 | A | 7/1990 | Acker et al. |
| 5,012,918 | A | 5/1991 | Acker et al. |
| 5,096,564 | A | 3/1992 | Jowitt et al. |
| 5,120,410 | A | 6/1992 | Herdzina, Jr. |
| 5,348,637 | A | 9/1994 | Kobayashi et al. |
| 5,391,277 | A | 2/1995 | Weng |
| 5,433,834 | A | 7/1995 | Belz et al. |
| 5,562,810 | A | 10/1996 | Urquhart |
| 5,817,220 | A | 10/1998 | Chen |
| 5,846,395 | A | 12/1998 | Sarrine et al. |
| 5,851,368 | A | 12/1998 | Rumph |
| 6,036,826 | A | 3/2000 | Kawachi et al. |

OTHER PUBLICATIONS

720–00020 (IDS–I) Picture of a chain for transmitting rotation (not for grounding)–Jun. 26, 1991.
720–00020 (IDS–2) Schematic of a chain for transmitting rotation (not for grounding)–Jun. 26, 1991.
720–00020 (IDS–3) Picture of a pinion gear for transmitting rotation (not for grounding)–Feb. 10, 1997.
720–00020 (IDS–4) Picture of a pinion gear for transmitting rotation (not for grounding)–Feb. 10, 1997.

*Primary Examiner*—Arun S. Phasge
(74) *Attorney, Agent, or Firm*—Andrus, Sceales, Starke & Sawall, LLP

(57) ABSTRACT

An e-coating line for small parts includes a series of load carriers, each having a rotatable shaft supporting an apertured metal barrel with parts to be treated. Electrically conductive drive chains and sprockets connect the rotatable shaft to barrel shafts to suspended the barrel from the carrier for submersion of the barrel into treating tanks including an e-coating tank. The chain/sprocket units are self cleaning and establish a reliable grounding of the barrels through the load carrier and slide rail conveyor conducting the load carriers to ground. A rack is mounted on a support secured to move with the load carriers. The rack engages a drive sprocket on the rotatable shaft. A push cylinder secured to the rack, moves the rack with the slide rail held stationary to rotate the shaft and coupled barrel. The system provides a low cost and effective grounding of the barrels and minimizes maintenance requirements and costs.

26 Claims, 5 Drawing Sheets

GROUNDING SYSTEM FOR ROTATING FIXTURES IN ELECTRICALLY CONDUCTIVE MEDIUMS

BACKGROUND OF THE INVENTION

This invention relates to an improved grounding system for fixtures supporting elements in a processing line and particularly for coating of small parts.

Various items and parts are processed through an electrically conductive fluid medium for treating, coating or otherwise acting thereon. In a practical system for processing, and in particular for coating or painting parts and particularly small parts, the parts are placed in an apertured container, such as a barrel, which is supported for placement in a series of separate treating containers or tanks for pretreating, coating and finally curing of the coated parts. Various systems have been proposed in which the small parts are placed in apertured barrels. The barrels are mounted in a processing line for sequential immersion in a series of tanks including liquids for treating of the parts prior to applying a desired coating and a subsequent curing of the coating. An automated processing system is disclosed in U.S. Pat. No. 5,012,918 issued May 7, 1991. The patents illustrate application to individual large parts, but has been now applied to barrel processing by providing of a rotating barrel structure specially supported for passing through the line, as more fully developed hereinafter.

The processing system provides for stepped movement through a coating apparatus of a series of in-line processing tanks. As generally disclosed in the above patent, a series of like-mounted barrels are mounted to a support and passed in steps through the system. The tanks are spaced such that a series of the supported barrels are moved a corresponding length, moving between stations during each cycle. During each cycle, selected barrels or all barrels may be lowered into the aligned tank for appropriate treatment for a fixed period after which the barrels are raised, moved another step into alignment with a subsequent processing tank. Thus, the barrels are releasably mounted within a stepped conveyor with appropriate means to lower and raise the barrels as they are aligned with the respective stations. The processing apparatus provides for removing of the barrels at the exit end during one treating cycle and providing for the addition of a new load at the entrance end during the same treating cycle.

The system thus provides for the continuous stepped in a line operation and treating of parts in the barrels.

With present technology in certain coating processes the barrels must be connected to common ground within the processing apparatus.

Presently, the barrel must be specially constructed to provide for grounding of the barrel at each station or selected stations for immersion within the liquid such as for electrotreating, electroplating, and for electrocoating of the parts. The barrel are presently connected through a special ground connection.

Various grounding systems are presently available. For example, a gear train secured to the shaft with an outer gear connected to a ground path. A hollow shaft with a grounded wire secured within the shaft in sliding engagement therewith has been proposed. A prior art coating support assembly or unit has been constructed including a rotating conductive shaft with a non-conductive chain and sprocket unit secured to one end support and a separate conductive bushing unit connected as a second support. The bushing unit is shorter than the non-conducting chain support and located above the first end. A cup-shaped portion or member on the part to be coated is aligned with and covers the conductive bushing unit and as the assembly is lowered into the liquid, an air cavity is created about the bushing unit and prevents liquid engaging of the bushing unit, and maintaining the ground connection. Other suggested systems have included exposing a part of the barrel above the liquid and applying a grounding shoe. The shoe would require a rough surface to insure grounding through paint on the barrel, which would cause potential wear of the shoe and barrel. It could also scratch paint off which would fall into the e-coat tank. However, all such units when immersed in the paint, require frequent and costly cleaning, paint removal and general maintenance.

In current practice for coating small parts, the parts are placed in barrels or baskets which are removed from the system for curing to avoid coating of the barrel or basket.

SUMMARY OF THE INVENTION

The present invention is particularly directed to a direct grounding of a rotating electrically conductive fixture for support work to be processed without the necessity of a special dedicated grounding system such as presently used. In accordance with the present invention, the fixture is rotatably suspended by an electrically conductive rotating support unit including a flexible belt-like suspension assembly which is electrically conductive and which is directly conductively connected to system ground of the apparatus and to the fixture. The fixture included a supporting shaft unit for holding the work, which may be an individual item, a container such as a barrel or basket holding a plurality of parts or other assembly to be rotated. Generally, the conductive suspension belt-like unit is supported on a rotating drive member which is connected to electrical ground, and includes a rotating and electrically conductive member secured to the fixture unit shaft unit to produce a direct rotational support and a drive connection with an electrically conductive path to ground.

The support unit is preferably a grounded chain system which rotatably supports the fixture shaft through the suspension unit and a conveyor system to electrical ground without the necessary gear train or other interposed connections of the prior art. The sprockets of the chain system are preferably mounted to the shafts with a highly conductive inner fixed attachment which on mounting forms an integral sprocket fixedly and tightly engaging the shaft to create a strong and electrically conductive connection.

The chain drive is preferably constructed to provide a self-cleaning chain unit formed on a conductive metal and connected directly by suitable sprockets to the rotating support shaft and to a barrel shaft unit. The load frame unit is connected directly to ground through the support structure thereof and thereby connects the chain and barrel to ground. A preferred self-cleaning chain creates a consistent and totally effective ground connection, with minimal initial costs as well as minimal subsequent replacement and/or maintenance.

Although the barrel is generally a metal member of good conductivity, the present grounding system is applicable to any electrically conductive barrel with a conductive supporting shaft structure.

In the preferred construction, in the raised transport position, the barrel unit includes a rotating drive which moves through the line without any rotation of the barrel. In the lowered position of the frame and barrel units into the treating tank, the barrel rotation drive is established through an actuated coupling to a barrel rotating mechanism.

In particular, in a preferred system construction, the load bar unit is moved through a slide bar conveyor such as disclosed in the previously identified patent. A rack unit for engaging a drive sprocket on each or selected support shafts is secured to move with the slide bar unit. In the movement of one station to the next, the rack and drive on the shaft move as a unit thereby providing for the movement of the barrel without rotation thereof. The rack is then actuated to rotate the shaft and the suspended barrel. The load bar unit or the rack may be constructed without providing for barrel rotation at any selected station.

In summary, the present invention provides at least one rotating suspension member which is a electrically conductive member with rotating members fixed to the rotating shafts to provide a grounded rotating support of a rotating fixture and having a frame connected within the conveyor which is connected to ground.

The present invention with the separate load bar assembly and chain or like belted mounting also provides a very convenient and effective structure for maintenance of the barrel and its supporting structure. Thus, the unit can be exposed at the end of a line and the load bar with barrel attached removed as a unit for maintenance and replacement. Alternatively, by raising only the barrel, it is released from the chain support and the barrel itself may then be removed for separate processing or maintenance.

The present invention is shown for a conventional barrel with an outer enclosure wall with connection to end walls. As noted previously, the ground support system may advantageously be applied to any fixture which needs to be reoriented for venting and draining of the part or parts within an immersing liquid or atmosphere for coating and/or treating of the work.

Although particularly applicable to a grounded barrel for e-coating of parts, the apparatus may be applied for other applications with an electric charge. The parts are electrically conductive and for e-coating are generally formed of metal which is compatible with a coating paint, generally cationic and anionic patents.

The present invention provides a very highly effective and lower maintenance for processing line including a rotating fixture or other like functioning supported unit.

BRIEF DESCRIPTION OF THE DRAWINGS

The drawings provided herewith disclose a preferred construction of a treating apparatus including rotating barrels constructed in accordance with a preferred embodiment of the present invention.

In the drawings.

DESCRIPTION OF ILLUSTRATED EMBODIMENT

Figure 1:
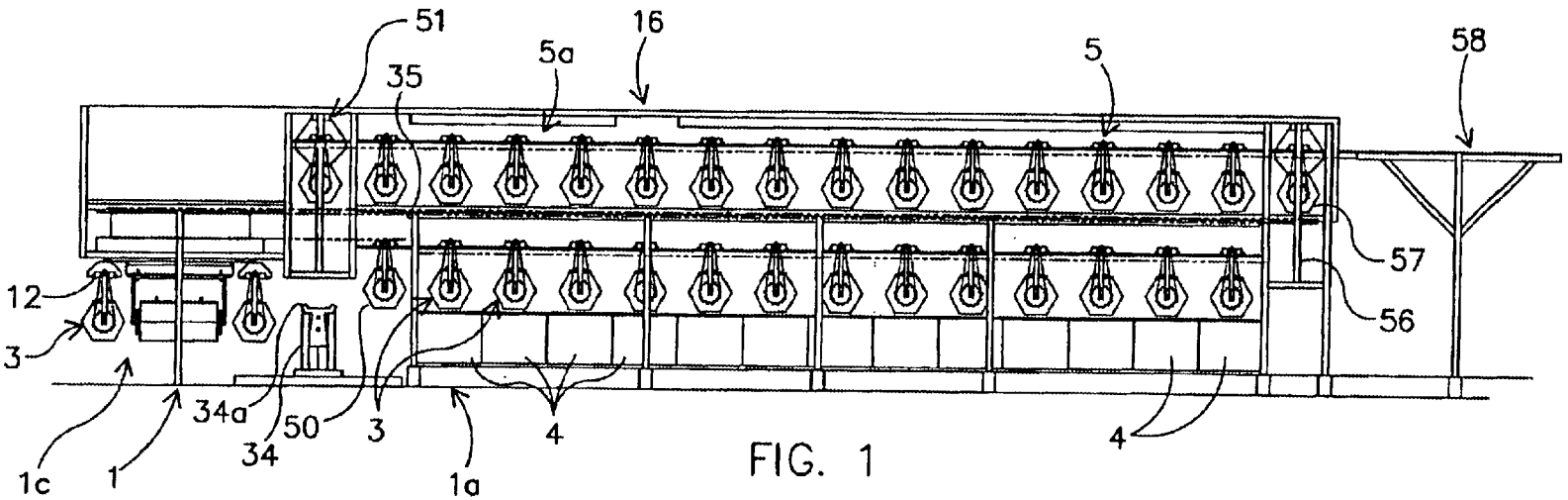
FIG. 1 is a pictorial view of a processing line for treating batches of small parts contained within rotatable barrels.
Figure 2:
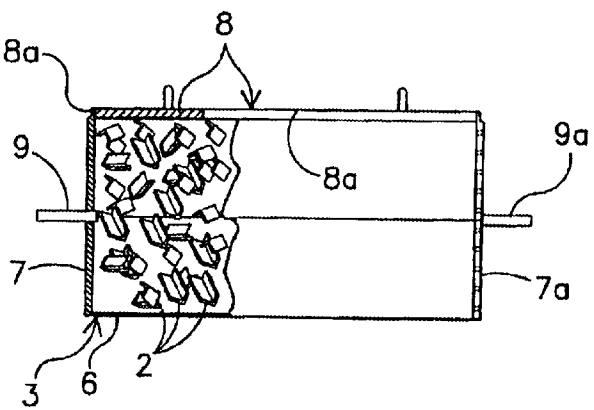
FIG. 2 is a separate enlarged view of a barrel constructed for containing a plurality of small parts for processing in the line of FIG. 1.

Referring to the drawings and particularly to FIGS. 1 and 2, an e-coating apparatus 1 is illustrated for coating small parts 2 contained within apertured barrels 3 with a suitable paint (as shown in FIG. 2). A plurality of the parts 2 are placed in each of a series of barrels 3, as shown in FIG. 2, which are then sequentially mounted within the apparatus. Each barrel 3 has its sidewall formed with many small openings 3*a* to allow liquid to flow into and from the barrel, as partially shown for example at 3*a* in FIGS. 2 and 3. The illustrated apparatus 1 includes a bottom or lower line 1*a* in which the barrels 3 are passed for coating and an upper line 1*b* in which the barrels 3 are passed for curing the coated parts and a final cooling section. A barrel transfer conveyor unit 1*c* at the input end of line 1*a* includes barrel assemblies for insertion into and removal from lines 1*a* and 1*b*. In line 1*a*, the barrels 3 are passed through a series of processing tanks 4 for various part treatments and coating. The processed barrels 3 at the discharge end of line 1*a* are raised and passed to line 1*b* including curing and cooling sections 5 and 5*a* located above the parts treating stations. A new barrel 3 is added at the infeed or load end of the line 1*a* and a finished barrel is removed from end of the line 1*a* and transformed to line 1*b* during the operative coating cycle with the barrels in the tanks 4 to maintain a continuous flow through the system in each cycle. The barrels 3 are assembled with a load support for movement through the lines 1*a* and 1*b* at a load/unload apparatus 1*c* adjacent the load end of the lines 1*a* and 1*b*.

In the several processing tanks 4 of line 1*a*, the barrels 3 are immersed within a treating solution or other atmosphere and rotated to sequentially properly clean, treat and finally coat the parts 2 through an electrocoating process which requires providing the treating liquid with a positive charge and the barrels with a negative charge which is created by grounding the barrel.

Figure 3:
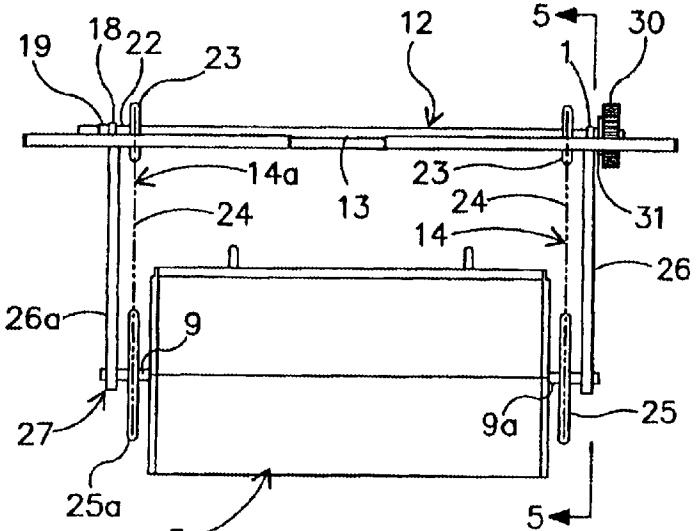
FIG. 3 is a view of a load bar unit for supporting the barrel of FIG. 2 in the system of FIG. 1.

Referring particularly to FIGS. 2 and 3, the illustrated barrel 3 is shown in one preferred construction and is illustrated with parts broken away to illustrate the support of parts 2 within the barrel.

The barrel 3, shown with parts broken away, is a metal member including an outer shell 6 with end walls 7 and 7*a*.

The barrel may be of any suitable cross-section and is shown as a hexagon with flat side walls, one of which is formed as a cover 8, releasably secured within an outer frame 8*a*. The parts 2 are placed within the barrel 3 and are free to rotate and move therein. Shafts 9 and 9*a* are secured to the end walls 7 and 7*a* and project on a common axis of rotation. The shafts 9 and 9*a* are welded or otherwise firmly affixed physically and conductively to the end walls to form a proper and strong support and with an electrically conductive connection to the barrel 3.

In the preferred construction, the barrel 3 is mounted to a load bar assembly or unit 12 (FIGS. 3 and 4) preferably with a special rotating drive which selectively rotates the barrel and simultaneously and continuously electrically grounds the barrel for movement through the processing line. The barrel is preferably constructed to allow the parts to continuously or selectively tumble within the rotating barrel for promoting proper coating of the parts.

The support of each barrel 3 through the line 1*a* is such as to avoid the need for any additional or special grounding system such as presently required by the prior art.

In particular, as shown in FIG. 3 a driven rotatable shaft 13 of the load bar carrier assembly or unit 12 is coupled by like drive chain units 14 and 14*a* secured between the shaft 13 and the aligned opposite shafts 9 and 9*a* of the barrel 3.

Figure 4:
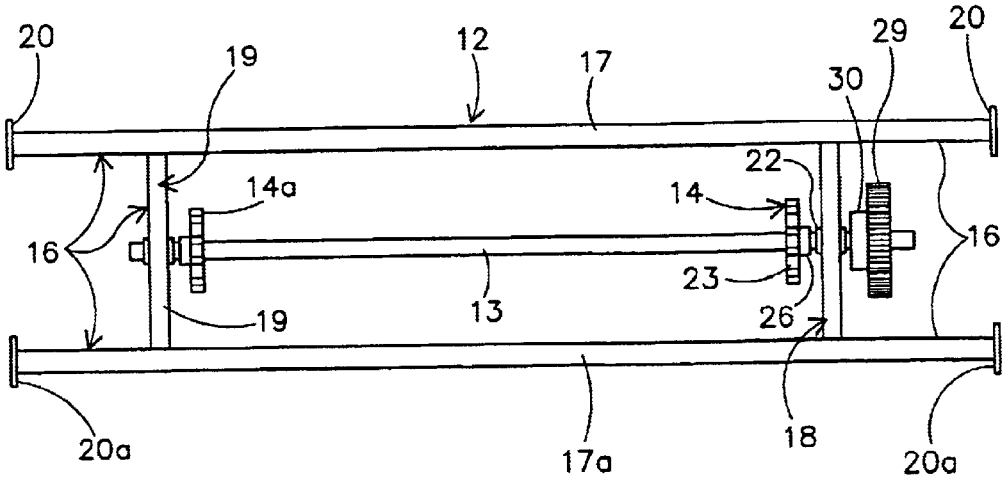
FIG. 4 is an enlarged top view of the load bar unit shown in FIG. 3.

More particularly, as shown in FIGS. 3 and 4 the illustrated load bar unit 12 includes a rigid rectangular frame 16 including extended side members 17 and 17*a* which are connected to each other by cross members 18 and 19 to form a substantially rigid frame support for the rotating shaft 13 The cross members 18 and 19 are located in inwardly spaced relation from the outer ends of the side member 17 and 17*a*. The ends of the member 17 and 17*a* include like end plates 20 and 20*a* which project outwardly in the plane of the members 17 and 17*a*. The frame 16 is constructed to match the spacing and location of the load support system of the processing line apparatus with the members 17 and 17*a* slidably mounted on a slide conveyor, as more fully described hereinafter.

The cross members 18 and 19 specifically establish a rigid, strong bearing support for the rotatable driven shaft 13 and the coupling thereof to the barrel 3 by the drive chain units 14 and 14*a*, similarly secured to the opposite end barrel shafts 9 and 9*a*, as follows.

Figure 5:
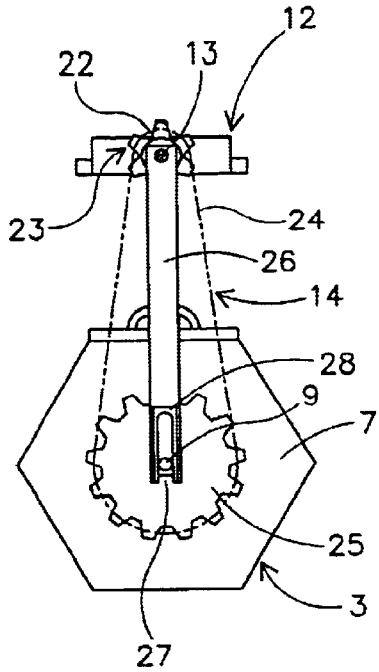
FIG. 5 is an enlarged sectional view taken on line 5—5 of FIG. 3 and more clearly illustrating a preferred mounting and suspension of the barrel from the load bar unit.

Referring to drive chain unit 14 (FIGS. 4–5), bearing unit 22 and 22*a* are secured within the cross members 18 and 19 with the shaft 13 extending therethrough and journaled therein for rotation. In the preferred construction, the bearings 22 and 22*a* are a high temperature conductive bearing such as provided by a carbon bearing or other suitable material.

A chain sprocket 23 is fixedly secured to the shaft 13 and receives a chain 24 of the drive chain unit 14. The sprocket 23 and the chain 24 are aligned with an appropriate sprocket 25 which is secured to the barrel shaft 9. The chain 24 engages sprocket 25 and directly supports the barrel, appropriately suspended and supported upon the driven shaft 13. The sprockets 23 and 25 and the chain 24 are all formed of electrically conductive metal elements which establish the shaft as a ground connection of the barrel to the load carrier which in turn is formed of metals to form a ground connection to the conveyor unit. The total mounting and connecting system includes electrically conducting components and serves to ground the barrel 3 through the grounded conveyor. The chains are preferably of a self-cleaning construction, such as a spreader chains and as, shown in FIGS. 6 and 6*a*.

Figure 6:
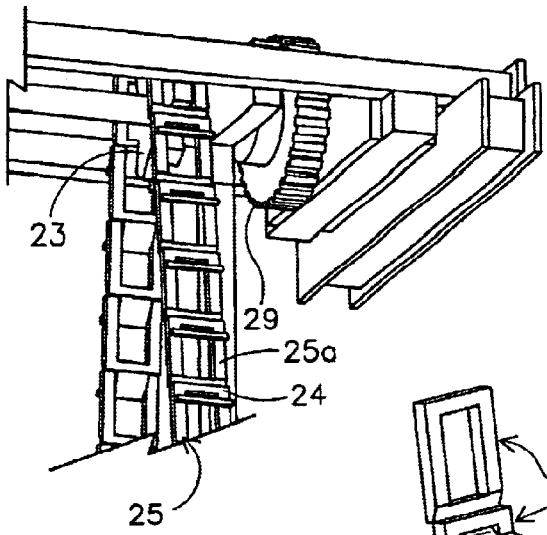
FIG. 6 is a separate enlarged fragment view of the drive chain shown in FIGS. 3 and 5.
Figure 6A:
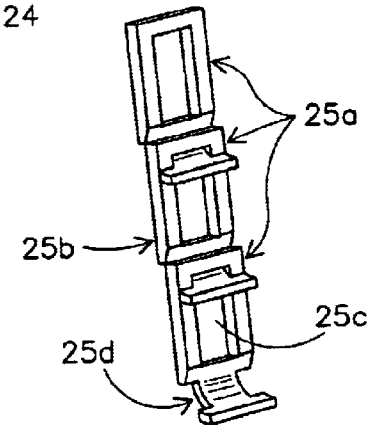
FIG. 6*a* is an enlarged pictorial view of the chain links shown in FIG. 6.

A particularly satisfactory heavy duty steel chain is illustrated in FIGS. 6 and 6*a*. Each link 25*a* of the chain includes a rectangular body 25*b* having a rectangular opening 25*c* and with a coupling T-shaped arm 25*d* connected by a curved arm connection at one end which fits within the rectangular opening 25*c* in the adjacent link 25*a*. The link 25*a* is preferably formed with a rectangular cross-section with sharp edges and function in operation as a self-cleaning linkage which prevents coating, clogging and/or binding. A chain of the above structure is available from Allid-Locke Industry.

The chain unit is a self-cleaning unit establishing a firm reliable electrical connection between the sprockets on the rotatable shaft 13 and the barrel shaft 9.

In addition, a rigid guide member 26, is shown journaled on the shaft 13 and extends downwardly with a lower slotted end 27 extended into guided support over the extended end of the barrel shaft 9. The slotted end 27 which may include a wear resistant liner 28 to accommodate rotational interengagement with the rotating shaft 9. The member 26 functions to maintain the barrel appropriately located on the load bar assembly or unit 12.

In the illustrated and preferred embodiment, the opposite end of the load bar unit 12 and the opposite barrel shaft 9*a* is connected by a like chain drive unit 14*a* to the bearing unit 22*a* on shaft 13 as well as having a similar guide member 26*a* extending from the driven shaft 13 and telescoped over the outer end portion of the shaft 9*a*.

Although shown with separate shaft members 9 and 9*a*, a single shaft may be used to support the barrel. Further, although two separate drive chain assemblies are shown and preferred, a single drive connection may be used with other suitable support at the opposite end of the barrel.

In addition, a driven spur gear 29 is fixedly secured to the load bar rotatable shaft 13, axially outwardly of the guide member 26. The spur gear 29 is fixed to the shaft 13 in any suitable manner for establishing selective rotation of the shaft 13 as hereinafter described, and thereby selective rotation of the barrel 3. In a preferred system, the spur gear 29 is a conventional spur gear having a connecting hub 30 securing of the gear to the shaft 13. The spur gear 29, as hereinafter described, is selectively driven during the immersion of the barrel 3 in a tank 4 to provide rotation of the barrel within the liquid or other fluid which is connected to an electrically positive conductive member, not shown, which is immersed within the liquid in the tank 4. The rotation of the barrel 3 establishes a tumbling of the parts within the barrel during the coating of the parts.

The spur gear 29 is shown driven in the preferred illustrated embodiment through mating with a rack 31 forming a part of a slide rail conveyor system (FIGS. 7–10), as hereinafter described.

The load bar unit 12 thus provides a reliable conductive support of its barrel 3 as well as providing for controlled rotation thereof. In addition, the chain units and the barrel shaft in combination with the frame structure which is mounted to a slide rail unit 32*a* (FIGS. 7 and 8) of the support apparatus. The system completely eliminates the necessity for bearings at the barrel and/or any special grounding connection to each barrel 3.

More particularly, as shown in FIGS. 8–11, the load bar units 12 with the barrels 3 attached are transferred to individual slide bars 32 of the slide rail conveyor 32*a* system.

In the illustrated embodiment, the slide rail conveyor 32*a* includes a process track 33, with the slide bars 32 moveably mounted within track 33. A hydraulic or motorized push member 33*a* (FIG. 11) is located at the entrance end of the conveyor and is mounted to move into the aligned end of track 33 to engage the aligned end slide bar 32 and move the abutting slide bars in accordance with the spacing of tanks 4.

As noted previously and also described in the prior art, load bar unit 12 with a barrel 3 in place (as shown in FIG. 1) is moved to the input end of the line 1*a* by a transfer cart 34 which has a suitable powered lift 34*a* such as a hydraulic or motorized lift. A hydraulic lift 34*a* is illustrated. Part 34 moves between the conveyor unit 1*e* and line 1*a*. The lift 34*a* operates to raise the load bar unit 12, with the opposite ends of the carrier frame members 17 and 17*a* off of conveyor 1*c* and moved to the entrance of the process track 33. When process track 33 raises, it picks up load bar unit 12 with slide bar 32 off of transfer car 34. In the slide rail conveyor, the individual slide bar 32 for each load is pushed through the track 33 of the conveyor system, with each movement moving the loaded bars and the new load unit a distance corresponding to the equalized spacing of the processing tanks 4.

Figure 14:
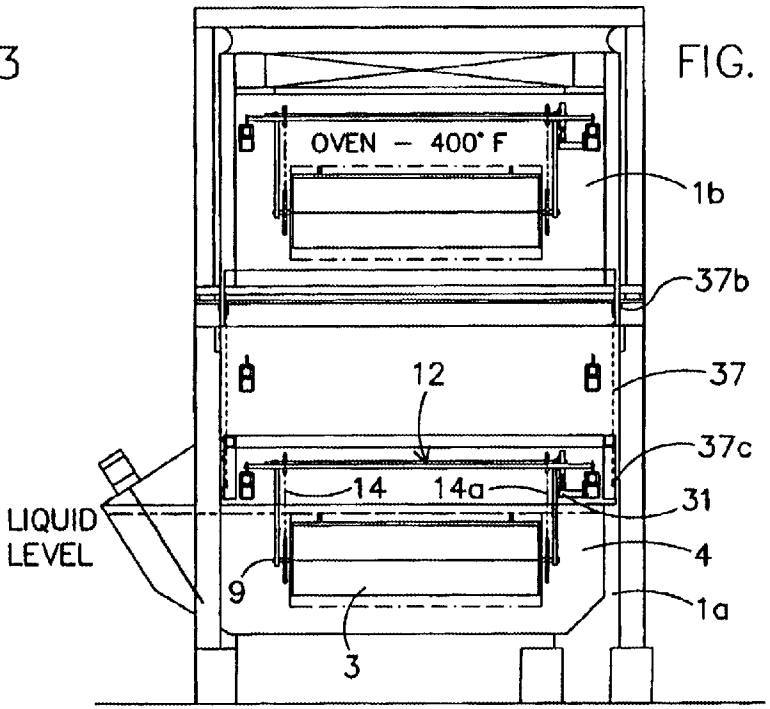
FIG. 14 is a diagrammatic illustration of the load bar unit and barrel lowered to the parts treating position at a given station.
Figure 13:
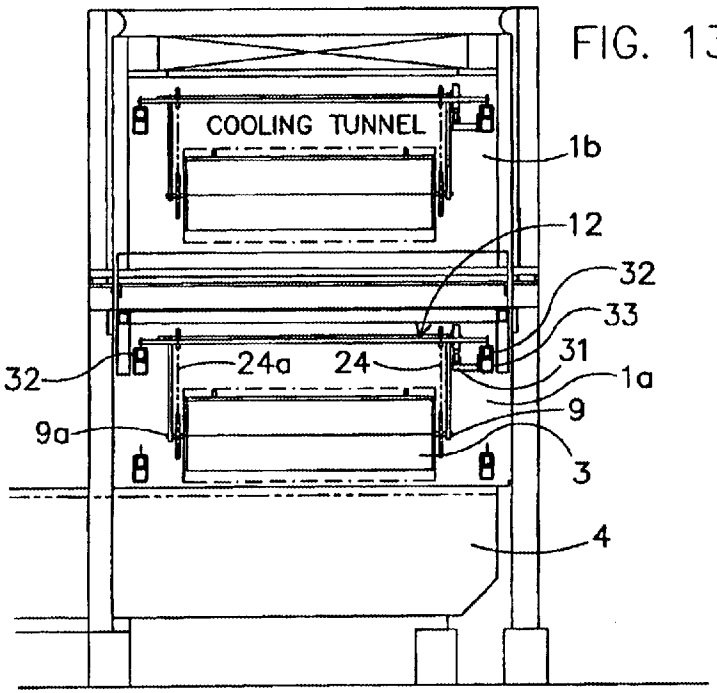
FIG. 13 is a diagrammatic illustration showing the load bar unit and barrel in a raised position for movement from one station to the next.

As shown in FIGS. 13 and 14, when the load bar units 12 are in position over a processing tank 4, the slide rail conveyor 32*a* is lowered through hydraulic or motorized support system, such that the barrel 3 and parts 2 are immersed in the aligned tank 4. After a selected period, the process track 33 and slide bar conveyor 32*a* are raised causing all barrels 3 with parts to be raised. The conveyor unit 32*a* is then stepped to move all slide bars and barrels one step.

Figure 10:
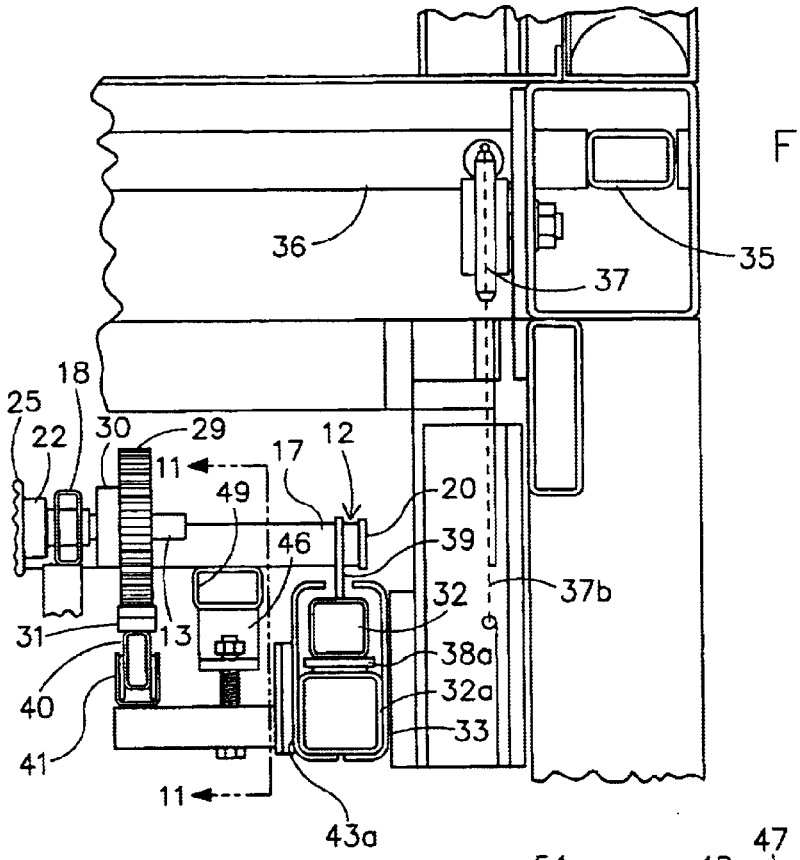
FIG. 10 is a view illustrating the slide rail unit and the rotating drive for a load shaft and a grounding plate unit.
Figure 15:
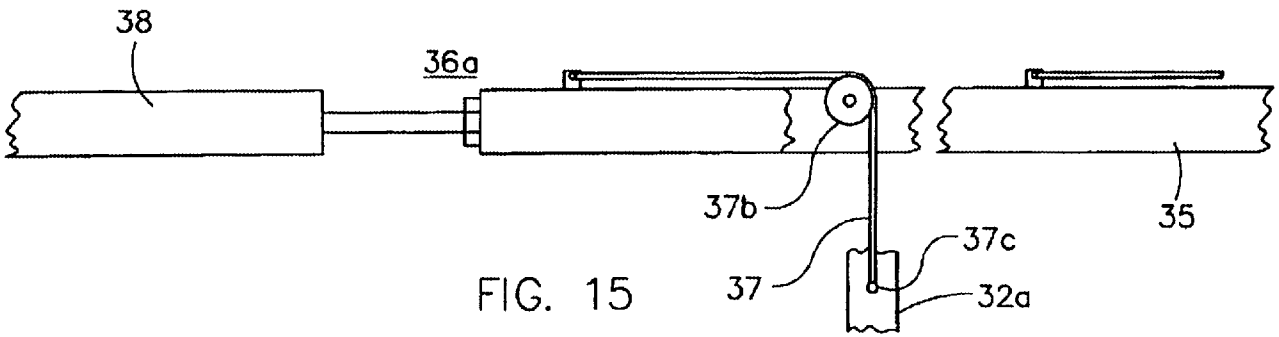
FIG. 15 illustrates a unit for raising and lowering of the conveyor and thereby the barrel units within the processing line.

In particular, the load bar unit 12 in the illustrated embodiment is mounted within the conveyor system including draw tubes 35 (FIGS. 10 and 15) spaced laterally and which are connected to each other by a connecting beam 36. The draw tubes are connected to a lift system 36*a* at the input or load end of the line 1*a* (FIG. 1). Chain units 37 are connected to the opposite sides to the conveyor at each station or tank 4 as shown in FIGS. 10 and 15 and extend upwardly through an opening 37*a* in a connecting beam. The end of the chain unit 37 is secured to the top of the aligned draw tube 35 as shown in FIG. 15. The actuator 38 is connected to the draw tube 35 for moving the assembly, with the separate chains 37 connection correspondently positioning the frame unit 12 and shaft 13. This provides for the raising and lowering of the tracks and therefore, the barrel 3 and parts 2 into and out of the processing tanks 4.

Figure 8:
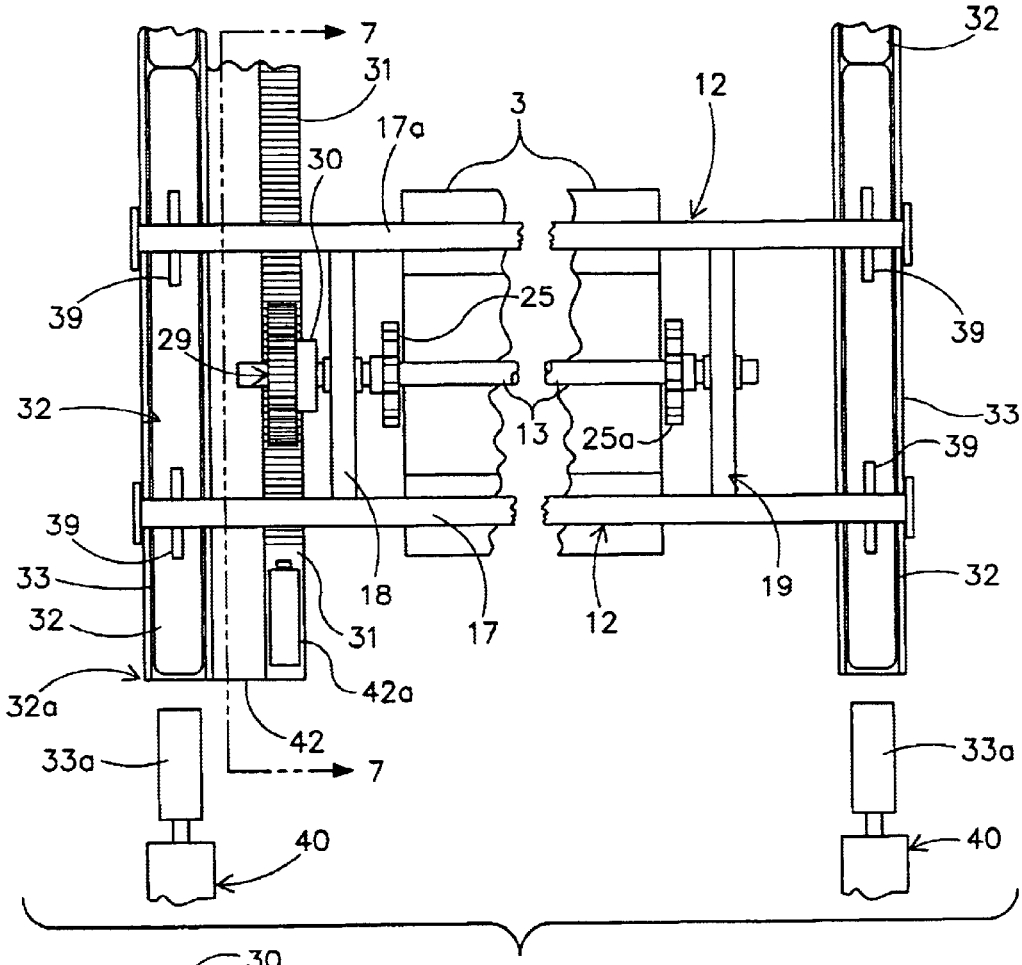
FIG. 8 is an enlarged illustration of the load bar unit and the barrel mounted in the conveyor.
Figure 7:
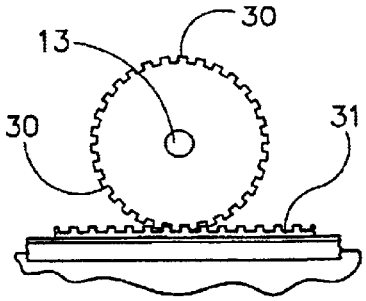
FIG. 7 is a cross-sectional view taken generally on line 7—7 of FIG. 3 and illustrating the barrel rotational drive connection in the illustrated embodiment of the invention.
Figure 9:
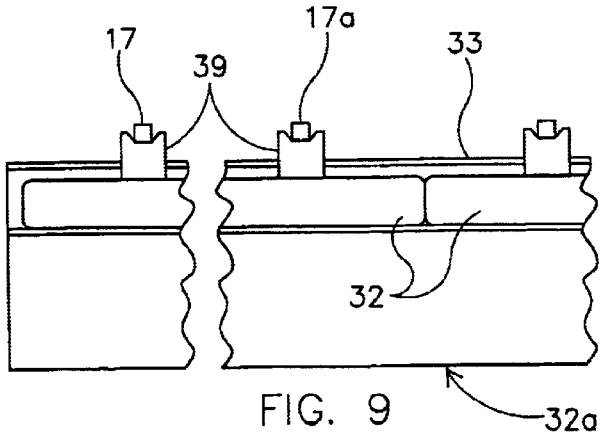
FIG. 9 is a fragmentary enlarged view of the slide rail of FIG. 8.

As most clearly shown in FIGS. 8–10; the slide bars 32 are slidably mounted in the process tracks 33. An individual slide bar 32 is provided at each end of load bar and frame assembly (12, 16–20) and each of which has a length equal to the length of the process push that is, the length required to move the load bar unit 12 and barrels 4 between the equalized spaced processing tanks 4. Each slide bar 32, as more clearly shown in FIGS. 8–10 is a rectangular or square body having appropriate wear pads and support 38*a*, in accordance with known construction for slidably moving within the corresponding process track 33.

Similar slide rail units 32*a*, one on each side of the conveyor, is provided for each of the side mounted load bar unit 12 with corresponding hydraulically actuated push units 33*a*. Each of the slide rails, and more particularly as shown in FIGS. 8 and 9, includes a recessed support 39 formed in or secured to the top wall of the rail. The supports 39 on the rail are spaced in accordance with the spacing of the two frame members 17 and 17*a* of the load bar unit 12. Thus, when the load bar unit 12 is deposited on the slide rail 32 and particularly supports 39, the two frame members rest in respective recesses on the slide bar to the opposite side of the barrel, and are mounted in a very stable support structure for movement through the lines 1*a* and 1*b*.

Figure 12:
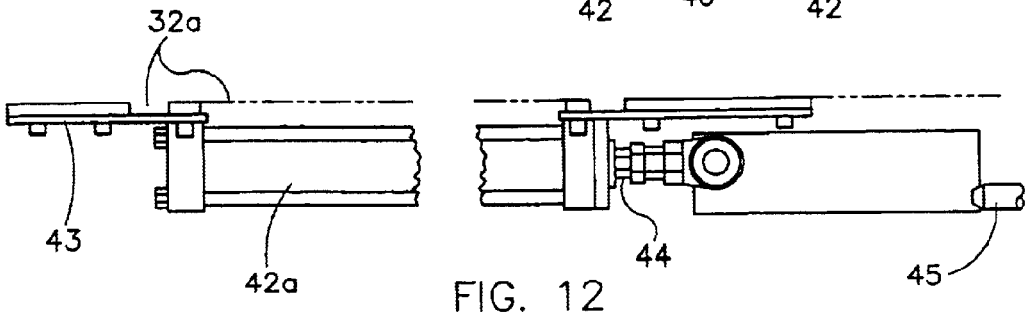
FIG. 12 is a view illustrating a drive unit of a rack unit for rotating the load shaft.

The process rack 31 is extended throughout the entire length of the process track 33 and thus throughout the length of the processing line or stations. Referring to FIGS. 10 and 12, the rack 31 is secured to a sliding beam 40 mounted within a u-shaped support 41 secured to arms 42 extended from the slide conveyor at each tank 4. A suitable actuator 42*a*, shown as a hydraulic unit, in FIGS. 8 and 12 is secured by a plate 43 to the side plate of the slide rail unit 32*a*. The piston rod 44 is secured to an offset plate or arm 45 which in turn is secured to the rack beam 40, as shown in FIGS. 10 and 12. As the slide rail unit 32*a* is actuated to advance the load bar assemblies 12 the rack actuator 42*a* is also operated to move the rack beam 40, and attached rack 31 at the same rate as the load bar 12. The barrel 3 is thereby held in a non-rotating transport position to the next tank 4. After the load bar units 12 are dropped, the actuator 42*a* is operated to move the rack beam 40 and the attached rack and thereby to rotate the grounded barrels 3 within the tanks 4.

In summary, the process rack stroke is operated in accordance with a program system during the immersion time of the cycle. This results in appropriate rotation of all barrels 3 coupled to the rack 31, and provides the desired treatment of each barrel 3 and the parts 2 at each station. If for any reason, a barrel should not be rotated at a particular tank, the rack may be constructed with the drive teeth removed, as by removal sections or other means for each selected tank.

Figure 11:
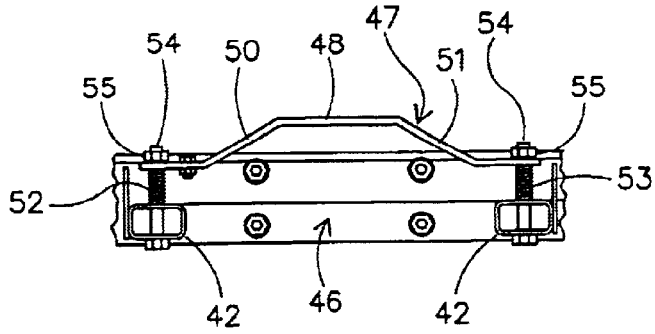
FIG. 11 is a sectional view of the grounded slide unit taken generally on line 11—11 of FIG. 10.

Referring to the drawings and particularly to FIGS. 10 and 11, a grounding unit 46 is mounted to and includes the spaced beams or arms 42 secured to slide plate 43*a* of the slide rail conveyor unit 32*a* and the rack guide channel or truncated member 41. The unit 46 includes a slide plate 47 having a flat wall 48 abutting the underside of a fixed beam 49 of the conveyor frame structure. The plate 48 includes opposite flat end legs 50 and 51 of a generally L shape with opposite end base legs.

The legs are mounted on springs 52 and 53 and held in place by threaded bolts 54 extended through the legs and springs and the cross beams supporting the rack assembly 39 to the slide rail unit 32*a*, with a nuts 55 at each end to establish a controlled pressure engagement of the slide plate 47 to the grounded frame 49.

A similar ground unit is mounted at each tank or station 4 to establish a firm ground connection of the load bar assembly 12 to the grounded conveyor support structure 49, and thereby the load shaft 13, the chain 14, sprockets 23 and 25 and the barrel 3.

During the immersion cycle, the system operates a hydraulic transfer unit 56 at the end of line 1*a* to transfer a load unit 57 from the end of line 1*a* to the entrance of line 1*b*. A hydraulic push unit 58 at the entrance end then operates to step line 1*b* and move a finished load 59 to the end of line 1*b* in alignment with a lift unit 60.

More particularly, with the system fully loaded as shown in FIG. 1, a load bar unit 12 and supported barrel 3 has been already placed into the appropriate position for entry into line 1*a* by the transfer unit 34. Line 1*a* is in position to lower the load bar and barrel units.

The finished load assembly 59 in line 1*b* is lowered by a lift unit 60 and aligned for transfer to the slide rail conveyor unit 32*a*. When the process track 33 is lifted to the up position, the conveyor unit 32 is then again stepped to move all slide bars and barrels ahead one station.

Once the slide bars and barrel move ahead one station, the process track 33 lowers the finished part 59 onto transfer unit 34 and also all other barrel 3 into tanks. The transfer unit 34 retracts and transfers the same to conveyor 1*c* for unloading or return to line 1*a* to be passed through the apparatus line for another coating.

The several lifts 34, 22*a*, 57 and 60 are thus operated in interrelated sequence with the proper movement and transfer of the various load bar units 12 and attached barrels 3 and synchronized to permit continuous and successive operations by providing transfers during the cycle processing in lines 1*a* and 1*b*.

The illustrated embodiment discloses a preferred construction in which the frame unit is connected to ground and grounds the suspension unit. Any other system may be used which connects the suspension unit to ground. For example, a ground connection directly to the shaft 13, which may be otherwise separate from a ground connection may be provided.

Although the suspension system preferably includes a self-cleaning chain system, and particularly a chain unit which functions as that shown, any other flexible suspension system may be used which includes a direct conductive shaft connections with a direct effective electrical grounding and rotational drive of the fixture, without use of separate bearing units at the fixture shaft. For example, a flexible belt which is conductive may be suspended on suitable conductive roller units which are connected to a drive unit and to the fixture shaft assembly respectively, the roller units and belt preferably incorporate means to maintain the belt and roller units free of the paint or other materials which may interfere with the grounding. Further, although shown with the belt suspension unit to each side of the barrel or other fixture, a single conductive unit may be provided to one side and any other suspension system or other suitable support on the opposite side of the barrel or other fixture. In summary, the present invention may be applied to any fixture by providing a suspension system which includes a conductive endless member electrically coupled by rotating members fixed to a grounded shaft and to the rotating fixture.

Although shown in a preferred system with various hydraulic operative units for positioning and moving various elements, other operating systems such as pneumatic or other motorized drives may be used.

Further, although shown in a preferred in-line system, the novel support may be advantageously applied to other systems which require processing of product within a rotating barrel or other rotating supported work units. For example, a programmed hoist on a monorail conveyor system, powered walking beams, free conveyor units and other applications which require selective grounding of a rotating barrel. The structure is shown applied to an e-coating line. The system may be applied in any system where the work is lowered into a liquid or other atmosphere which is electrically activated for applications to elements to be immersed and treated thereby, with rotation thereof.

In summary, the present invention provides a direct rotational drive with a conductive suspension belting unit coupled to ground and to a drive shaft and directly connected to the rotary support for a barrel or other fixture. The system not only avoids the complex and costly prior geared drives but permits more convenient and less costly repair and maintenance.

The illustrated embodiments discloses a preferred and unique construction. Other systems may be used with the illustrated conveyor or other conveyor systems which include a rotating support for coupling a fixture by a conductive suspension system.

We claim:

1. A suspended rotating fixture configured to be immersed within a fluidic and electrically conducting fluid medium and to be suspended from a rotating electrically conductive shaft unit connected to a first side of a power supply and configured to support at least one electrically conductive element within said electrically conductive fluid medium connected to the second side of said power supply, said shaft unit comprising:

an element support structure to support at least one of said elements, said element support structure including opposite aligned first and second end shaft members for a rotating support of said element support structure;

first and second suspension units connected to said shafts of said element support structure to support said fixture from said rotating electrically conductive shaft unit with the element support structure immersed within said electrically conductive fluid medium, a first of said suspension units being a flexible suspension unit including a first rotating member conductively fixed to a first of said end shaft members and a second spaced rotating member aligned with said first rotating member and forming a part of said rotating electrically conductive shaft unit, and a flexible electrically conductive belt member coupled to said first and second rotating members to support said fixture from said rotating electrically conductive shaft unit.

2. The suspended rotating fixture of claim 1 wherein said belt member and said first and second rotary members are constructed to minimize coating thereof with said fluid medium.

3. The suspended rotating fixture of claim 1 wherein said first and second rotating members of said first suspension unit include conductive sprockets and said flexible electrically conductive belt member is a chain unit mating with said sprockets.

4. The suspended rotating fixture of claim 3 wherein said chain and sprocket include mating elements interacting to remove coating from the same.

5. The suspended rotating fixture of claim 3 wherein the second of said suspension units include an electrically conductive chain coupled to an electrically conductive mating sprockets corresponding to the first suspension unit.

6. The assembly of claim 1 wherein said fixture includes a barrel having said shafts extending from opposite ends of the barrel, said electrical conductive suspension unit means including first and second flexible and electrically conductive endless members connected one to each of said shafts and to said rotating shaft.

7. The suspended rotating fixture of claim 1 wherein said fixture includes a rotating apertured container, and having said first and second end shafts conductively fixed to the opposite ends of the container.

8. The suspended rotating fixture of claim 1 or 7 in combination with said rotating conductive support shaft unit configured to be releasably mounted within a conveyor including a series of element support units, said conveyor including a grounding unit coupled to said rotating conductive support unit to connect the conductive shaft of said fixture to ground.

9. The fixture of claim 8 wherein said conveyor is a slide rail conveyor with slide rails to each side of the fixture and each including a series of like electrically conductive slide bars connected to said ground unit, each of said rotating electrically conductive shaft units including a frame unit mounted to said slide bars and including a rotating electrically conductive shaft within said frame unit coupled to said electrical grounding unit.

10. The fixture of claim 1 wherein said fixture includes a rotating barrel for small parts, said barrel having said first and second end shaft members extending from opposite ends of the said barrel, sprockets connected one to each of said first and second end shafts and aligned sprockets connected to said rotating electrically conductive shaft unit, each of said suspension units including first and second flexible and electrically conductive endless chains connected one to each of said aligned sprockets secured to each of said end shaft members and to said sprocket secured to said rotating electrically conductive shaft unit.

11. The fixture of claim 10 wherein each of said electrically conductive suspension units includes an electrically conductive chain coupled to matching sprocket on said rotating shaft and to said end shafts of said barrel to rotate said barrel and establish said electrical grounding of said barrel.

12. The rotating drive and support assembly of claim 11 wherein said chain is a self-cleaning chain to maintain the conductivity of the chain and the connection of the chain to the frame and to the barrel.

13. The rotating drive and support assembly of claim 11 wherein said chain is a spreader chain.

14. The rotating drive and support member of claim 13 wherein said chain includes a series of links, each link including an open frame with an integral offset neck with the offset neck constructed to connect within the open frame of the adjacent link to form an endless electrically conductive chain.

15. The assembly of claim 14 wherein said frame and neck are formed with a rectangular cross-section with sharp edges to establish a non-clogging chain with the links in electrical contact with each other.

16. The suspended rotating fixture of claim 1 wherein said fixture is an electrically conducting barrel having parallel end walls with said first and second end shafts secured thereto, a frame structure with said rotating electrically conductive shaft unit rotatably mounted therein, said frame structure constructed to be releasably mounted within an electrical conductive conveyor unit for selective immersion of said barrel within a series of tanks at least some of which include said electrically conductive medium for treating parts within said barrel.

17. A rotating drive and support assembly for treating elements in a barrel within a liquid comprising a mounting structure including an electrically conductive and grounded frame unit including a rotatable shaft, a barrel adapted for containing small parts and including projecting shaft members from the opposite ends of the barrel for rotatably mounted thereof said barrel including a container connected to said shaft member and having openings for introduction of a conductive liquid with said shaft member within said liquid, first and second corresponding drive assemblies each coupling of one of said projecting shaft members to said rotatably shaft, each drive assembly including a first sprocket and a second sprocket connected directly to said shaft of said frame shaft and said fixture and a chain connecting said sprockets.

18. The assembly of claim 17 wherein said sprocket and chain are formed with a rectangular cross-section with sharp edges to establish a non-clogging chain drive and with the links in electrical contact with each other.

19. The assembly of claim 17 wherein said grounded frame unit includes a spring loaded grounding contact unit for engaging a fixed grounded support.

20. The rotating drive and support assembly of claim 17 in combination with a processing line including a plurality of process stations, a conveyor having a series of like support means for receiving and supporting said frame units, said support means being connected to electrical ground to ground said frame, and means for moving said conveyor to align said support means and connected barrel with said process stations.

21. The assembly of claim 20 including a lift system connected to the conveyor and operable to raise and lower the conveyor and thereby the barrels into and from the treating stations, said lift system including a common elongated lift frame extended the length of the line including all said treating stations, a plurality of lift units connected to spaced locations along the conveyor and connected to said elongated lift frame to raise and lower said barrels.

22. The assembly of claims 21 wherein each said conveyor lift unit includes a chain connected to the conveyor frame at each station, a chain sprocket member secured to the conveyor in line with each chain, said chain being wrapped over the sprocket member and connected to the elongated lift frame member.

23. An apparatus for processing of parts within a barrel immersed in an e-coating medium and mounted within a conveyor unit; comprising a barrel having a supporting shaft, a barrel support unit including a rotating shaft constructed for connection to an electrical ground and supported to lower and raise the barrel into and from a treatment tank, means to ground said rotating shaft, each said supporting shaft and said barrel shaft having a electrically conductive sprocket affixed to the respective shafts and having the sprocket members in alignment, and an electrically conductive endless chain members connected about said sprockets and supporting said barrel for rotation in response to rotation of said rotating shaft with said barrel including said support shaft within said e-coating medium, and driven gear connected to said rotating shaft, a driven gear coupled to said rotating shaft.

24. The apparatus of claim 23 including said conveyor including a series of conveying supports for said barrel support units, said conveying supports mounted in a slide rail unit, a beam support connected to said conveying supports, a rack unit connected to said slide rail unit, said rack unit having a frame secured to said slide rail and moving with the slide rail and a rack mounted to said frame, and an actuator connected to said rack and mounted to said frame for selective rotation of said sock and said drive gears of said load bar units.

25. The apparatus of claim 24 wherein said means to ground includes a grounding unit secured to said conveyor, said grounding unit comprising a grounding plate aligned with said rack unit, spring loaded clamping units securing said grounding plate to said rack unit and biasing said plate into engagement with said grounded frame member and thereby connecting said load bar and barrel to ground.

26. The apparatus of claim 24 wherein said grounding unit comprising an electrically conductive support member secured to the conveyor in electrical conductive contact with the load bar unit, said grounding unit including a spring-loaded contact plate secured to said conductive support member and resiliently engaging an electrically conductive grounded frame member.

* * * * *